United States Patent [19]

Gorman

[11] Patent Number: 4,993,485

[45] Date of Patent: Feb. 19, 1991

[54] EASILY DISASSEMBLED HEAT EXCHANGER OF HIGH EFFICIENCY

[76] Inventor: Jeremy W. Gorman, 1095 Middlebury Rd., Middlebury, Conn. 06762

[21] Appl. No.: 408,663

[22] Filed: Sep. 18, 1989

[51] Int. Cl.[5] ..... F28F 13/02

[52] U.S. Cl. ..... 165/85; 165/109.1; 165/158; 165/174

[58] Field of Search ..... 165/85, 109.1, 158, 165/174

[56] References Cited

U.S. PATENT DOCUMENTS

| | | | |
|---|---|---|---|
| 4,174,750 | 11/1979 | Nichols | 165/109.1 X |
| 4,559,998 | 12/1985 | Counterman | 165/109.1 |
| 4,564,066 | 1/1986 | Gorman | 165/109.1 X |
| 4,641,705 | 2/1987 | Gorman | 165/85 |

*Primary Examiner*—Robert G. Nilson
*Attorney, Agent, or Firm*—Robert S. Smith

[57] ABSTRACT

A heat exchanger comprising an outer envelope having an inlet and an outlet for passage of an associated first heat exchange fluid therethrough. A first tube is mounted within the envelope for external contact by the first heat exchange fluid, and adapted for passage of a second heat exchange fluid therethrough in physical isolation from the first exchange fluid. A generally helical blade is disposed within the first tube for free rotation and free axial movement. The blade has a laterally centered bearing portion on at least one end thereof which has a diameter relative to that of the first tube, such as to cause the helical blade to pass in closely spaced relation to the inside surface of the first during rotation. A bearing member is disposed adjacent at least one end of the helical blade which comprises a porous member disposed in substantially aligned relationship with the helical blade. The apparatus also includes apparatus for directing the second heat exchange fluid, the bearing member extending across substantially the entire extent thereof whereby the second heat exchange fluid passes through the bearing member.

17 Claims, 3 Drawing Sheets

EASILY DISASSEMBLED HEAT EXCHANGER OF HIGH EFFICIENCY

RELATED APPLICATIONS

This application is related to prior applications 287,941 filed July 28, 1981, pending application 522,033 filed Aug. 9, 1983 and 747,965 filed June 24, 1985. The latter two such applications have now matured into U.S. Pat. Nos. 4,641,705 and 4,564,066 in which the patentee is the same as the applicant herein.

BACKGROUND OF THE INVENTION

The invention relates to heat exchangers and particularly to heat exchangers having a tube construction in which a free-floating helical member is disposed in the tube to promote heat transfer. More particularly, the invention has particular application for use with a liquid to air fin-type heat exchangers, double-pipe heat exchangers, and shell-and-tube type heat exchangers. In the present inventor's previously issued U.S. Pat. Nos. 4,564,066 and 4,627,349 there is disclosed apparatus which includes a free-floating helical strip in the tubes of the heat exchangers of various designs. Various structures are shown for retaining these helices in place without restricting their free rotation or the flow of fluids past them. The helices in the previously issued patents were closely fitted to the inside diameter of the respective tubes so that as the helices turned, they scraped away the hydrostatic film which naturally accumulates on any solid surface immersed in a fluid. This film is the largest barrier to heat transfer since fluids have heat conductivities two or three orders of magnitude less than metals from which heat exchangers are constructed. The helical shape was provided to make the scraping edges turn in response merely to the flow of fluid in the heat exchanger tube.

The apparatus described in the noted patents offer significant improvements in heat transfer. It has now been determined that certain further improvements could be made in the apparatus described therein.

It is an object of the invention to provide a screening or filtering action for the fluids being heated or cooled in the heat exchanger.

It is an other object of the invention to provide for easy removal, cleaning, inspection and replacement of the heat exchanger as well as any filtering or screening element.

Another object of the invention is to provide apparatus which will minimize any pressure drops in the fluid being heated or cooled.

Still another object of the invention is to minimize the space required in a shell-and-tube heat exchanger between the bearing surface and the tube-plate of such heat exchangers.

Another object of the invention is to provide apparatus which is less sensitive to high pressures and particularly to rapid changes in pressure.

Yet another object of the invention is to simplify the construction of the apparatus and to make it suitable for more applications.

SUMMARY OF THE INVENTION

It has now been found that these and other objects of the invention may be attained in heat exchanger which includes an outer envelope having an inlet and an outlet for passage of an associated first heat exchange fluid therethrough. A first tube is mounted within the envelope for external contact by the first heat exchange fluid, and adapted for passage of a second heat exchange fluid therethrough in physical isolation from the first heat exchange fluid. A generally helical blade is disposed within the first tube for free rotation and free axial movement, the blade has a laterally centered bearing portion on at least one end thereof. The helical member has a diameter relative to that of the first tube, such as to cause the helical blade to pass in closely spaced relation to the inside surface of the first tube during rotation. A bearing member is disposed adjacent at least one end of the helical blade which comprises a porous member disposed in substantially aligned relationship with the helical blade. The apparatus also includes apparatus for directing the second heat exchange fluid, the bearing member being disposed in the apparatus for directing and extending across substantially the entire extent thereof whereby the second heat exchange fluid passes through the bearing member.

This embodiment of the apparatus in accordance with the invention may further include the helical blade having at least one axial extremity that is a bearing surface for cooperation with the bearing member. The bearing surface may be rounded and have a radius of curvature that is at least as great as the inside radius of the first tube.

In various embodiments of the invention the bearing member is a mesh screen. In some cases the mesh size is between 10 and 20 mesh or between 60 and 100 mesh. In various other embodiments the bearing member is terracotta, frittered glass or sintered metal.

Some embodiments may have means for directing that includes a generally U-shaped tube engaging the first tube. The generally U-shaped tube may have a diameter greater than the first tube and the bearing member may be disposed intermediate the first tube and the U-shaped tube. Other embodiments may include other means for holding the bearing member in the means for directing. These may include interconnecting axial extremities of respective tubes having different diameters and the bearing member is trapped by the interconnecting axial extremities. Sealing means may be disposed around the peripheral portions of the bearing member.

Other embodiments may include means for quickly connecting and disconnecting a fluid coupling to the heat exchanger including axially tapered first and second flanges and a clamp which has an internal circumferential V-shaped grove to clamp the first and second flanges together. The clamp may include first and second actuate sections which are pivotably connected to allow insertion of the first and second flanges therebetween.

BRIEF DESCRIPTION OF THE DRAWING

The invention will be better understood by reference to the accompanying drawing in which.

DESCRIPTION OF THE PREFERRED EMBODIMENT

Figure 1:
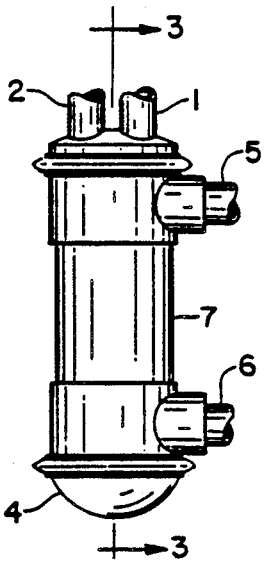
FIG. 1 is a front elevational view of a tube and shell heat exchanger in accordance with one form the invention.

The present innovation utilizes the basic structure disclosed in inventor's prior heat exchanger patents referring to herein, but is modified so as to provide the additional advantages of: (1) Screening, or filtering action for the fluids being heated or cooled. (2) Easy removal for cleaning, inspection or replacement. (3) Reduced tendency to impose pressure drops in the fluid being heated or cooled. (4) Reducing or minimizing the need for spacing between the bearing surface and the tube-plate of a shell-and-tube beat exchanger, (5) Making the device less pressure sensitive, so that it cannot be easily destroyed by use of excessive pressures in pumping the fluids, (6) Simplifying the construction of the device, and making them more universally applicable. (7)

Providing ready access and maintenance desirable for any device for long service: but absent from most heat exchangers.

The present invention utilizes bearing plates, or retainers that are made of porous materials or screen instead of perforated solid elements. This structure thus becomes a fluid cleaning element as well as being more versatile for its use as a bearing plate for the helices.

Screens, porous materials, sponge metals, or frittered glass or ceramics were not disclosed in the earlier patents, and their use provides some unexpected advantages worthy of further elaboration and exploitation. Cleaning the fluid is desirable, since accumulations of particles and other debris from degradation or contamination can cause problems elsewhere in the system also. Consequently, the apparatus of the present invention has been devised including the screen and the bearing or retaining plate and the construction which makes it easily removable and replaceable. In this manner the bearing plate becomes multi-functional and also acts as a screen or filter which can clean the fluid and be replaced as debris from the fluid clogs the screen. For viscous fluids the bearing plate should be made of 10 or 20 mesh screen, to allow the fluid to pass easily. For gases, terracotta, frittered glass, or fine screens such as 60 to 100 mesh maya be better suited. For some applications the bearing plate or member may be sintered metal which is also porous.

If screening is to be used, various weaves are commercially available. The most open weaves are best. In the case of a shell-and-tube heat exchanger, for example, one bearing element serves as a retainer for a multitude of helices. The aggregate cross-sections of the tubes varies from 10% to about 40% of the total cross-section of the shell. Since the bearing element fits over the entire cross-section of the shell, as long as the screen is more open that the tube plate, the drag it imposes on the fluid cannot become a significant restriction on the flow, or cause measurable pressure drop. The use of a screen or other porous material greatly simplifies the manufacture of the bearing element, since the passage of the fluids is uniformly distributed over the entire surface, and no design of a pattern of holes, or judiciously placed slots is required. In addition as long as the openings in the screen are substantially smaller than the holes in the tubes, the screen can be placed directly against the tube-plate of the heat exchanger, and the fluid can still easily find a pathway through. This feature greatly eases the mounting design of the bearing element, since the spacing between it and the tube-plate need be neither critical, nor large. The preferred embodiment of this invention, does not place the bearing element directly against the tube plate, however, since imposing an unnecessary restriction upon the flow of fluids cannot be condoned.

One of the major improvements in the present invention is the ready disassembly and reassembly of the unit for the purpose of cleaning, or changing either helices or screen-bearing plates. In shell-and-tube heat exchangers, the cap or end-plate is commonly bolted to a flange on the tube-plate. Smaller units up to 4 inches in diameter often have four, bolts holding the end cap securely to the tube-plate flange: to prevent leakage, or separation in case of over-pressurization. Larger units from 5 to 36 inches in diameter have anywhere from 6 to 60 such bolts, or even more. These holes impose a fairly stringent demand on the design of the gasket to seal the end plate against the flange of the tube-plate. They also represent a major time-consuming project to remove if the unit needs to be opened for any reason including failure or cleaning. Still further, after even one disassembly they represent a serious source of leakage, and usually are replaced rather than reused.

In the present invention, there are no bolts holding the end-plate onto the tube-plate flange. There are also no bolt holes, nor any pre-drilled gaskets to match the bolt pattern of that particular heat exchanger, instead these two units of the same diameter are retained by a closely fitted circular channel which is part of the mounting bracket or stand. This channel is made with a slight taper so that as it is fitted onto the two flanges, it squeezes them together making a fluid-tight seal which will not allow any fluid from inside to escape to the outside. This closely fitted and tapered channel is spilt into two around their entire periphery with a rigid channel which retains them, and compresses a sealing gasket between them against any internal pressure. The unit can be opened at any time merely by removing the pins from the retaining channels, opening the channels and taking out the heat exchanger. The end cap and the header can then be separated merely by breaking the seal. If the seal is made of a heat and chemically resistant elastomer such as Viton, PTFE, EPDM or nitrile rubber, no gasket sealer is needed or recommended. The seal can then be reused.

The bearing element is mounted in, and becomes a part of the seal between the end-plate and the tube-plate. This is a relatively simple matter, since the bolt holes are no longer needed: and such holes need not be in the bearing plate. One easy method is to place the bearing element between two such pre-cut gaskets, and the job is complete. This process will also automatically assure that the bearing element is not directly against the tube-plate.

The reason for this easy access arrangement, is to provide a readily replaceable or cleanable screen or filter for the fluid being heated or cooled. This screen is also the bearing element for the helices in the tubes. Since the end caps are usually fitted to a permanent piping, these must be disassembled to allow the end caps to be removed. In the present design, the end caps need not be moved at all, and the body of the heat exchanger may be removed without disturbing the end caps. This further eases disassembly for cleaning or repair. Since the shell is commonly used for the cooling water, the body or shell can be fitted to flexible pressure hose so no piping need be disassembled at all.

In the present inventor's earlier design (U.S. Pat. No. 4,565,066): the tips of the free-floating helices were pointed to provide a center of rotation and a bearing point for its rotation. The angle of this point was 90 to 150 degrees to minimize the tendency of a sharp point to drill a hole in the bearing. In the present invention, there is no point on the end of the helix, since it could catch in the wires of a screen-bearing plate, or in the porosity of a porous bearing element. Such binding would immobilize the helix and stop its rotation. The ends of the helices of the present invention are cut in a circular pattern, with the radius of the circle being from 1 to 5 times the inside radius of the tubes into which they are inserted. This will further minimize the potential for wear, and avoid any possibility of a pointed tip becoming wedged into a screen opening and losing its rotation. It also minimizes the problem of putting the points at the exact center of the tube or helix. If the helices fail to rotate, they become turbulators, a long-known device to force fluids against the walls of a cooling tube to decrease the hydrostatic film. However, such turbulators, although effective, rely on a warm portion of a fluid to push away a cold portion of the same fluid and cannot remove the entire hydrostatic film. A solid helix will mechanically sweep away substantially all the stagnant film. The immobilization of the helix drastically reduces its effectiveness by eliminating the positive film removal in favor of partial removal by fluid flow. Even immobilized, however, the helix is considerably better than no helix at all. Thus, this design has a fail safe feature which assures improved performance even when the helix is stuck or otherwise immobilized.

A further advantage of the porous bearing element is that it simplifies the assembly of fin-tube or double-pipe heat exchangers using the helices. The care and precision required to make a tiny bearing point and suspend it firmly in the precise center of a small tube without restricting the fluid flow is eliminated. Most fin-tube heat exchangers having multi-pass tubes through a series of fins are assembled from straight tubes with a variety of U-shaped, L-shaped, or other end pieces to turn the fluid around for its next pass through the fins. In such an assembly the end pieces are flared to fit onto the ends of the straight tubes during assembly. If the porous bearing element is cut to the outside diameter of the inside tube, it can be placed on the end during assembly with no extra care or high precision. It can even be done by machine.

This feature eliminates the need for specially built pins, spiders or other retainers. The use of solder, adhesives, or brazing techniques that allow ready disassembly will also allow for the easy inspection, cleaning or replacement of the bearings or helices in the field. In double pipe heat exchangers, they may even be held together by clamps instead of being soldered, brazed or welded. This further eases the disassembly for cleaning or inspection.

Corrosion is a major cause of failure for heat exchangers of most types. The use of these helices and the porous bearing elements need not add to the susceptibility to corrosion, since they can easily be made of the same corrosion resistant material of which the heat exchanger is made. In fact the easy replace-ability of these elements can allow some additional corrosion protection, since they can be made of or coated with sacrificial corrosion elements such as magnesium. In many instances, simple tests of the effluent fluid can tell the operator when to replace these sacrificial elements.

Moving parts, and most particularly parts rubbing against one another, are of great concern to designers of devices for long service. Durability is conceived of as impossible with rubbing elements. However, when disassembly and reassembly are simple, inexpensive and non-time consuming, such concerns almost disappear. In the present invention, both the screen-bearing elements and the helices are easily removed and replaced. Depending upon the end-purpose of the heat exchanger, the construction of the helix, or of the screen can be made sacrificial to the other. Thus, if it is desirable to replace the bearing it can be made of a softer material such as copper, while the helix is made of stainless steel. If on the other hand, the porous bearing element is a ceramic which is much harder than the helix, the helix can be made soft and be replaced as it wears. The friction would be thus minimized and the wear purposely concentrated in the desired element. At the next cleaning, or if the sacrificial purpose has been used up the screen or helix can be readily replaced and the remaining element will be none the worse for wear. Wear is already noted to be extremely small since the loads are always very small and the bearing points are always lubricated by the fluid being cooled or heated. In addition the semicircular end shape of the helices will minimize wear by distributing the load over a larger area. The ready access and replace-ability of both of these elements the concern for wear as a major, or even as a significant cause of failure. In fact it adds a service-maintenance feature highly desirable to long term usage of my equipment, and presently absent from heat exchangers.

Figure 2:
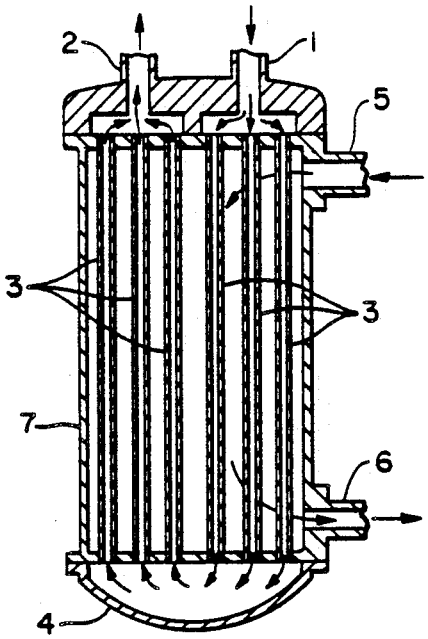
FIG. 2 is a sectional view of the apparatus shown in FIG. 1 taken along a vertical plane extending through the center line thereof.

Referring now to FIGS. 1–5 there is shown a double pass shell-and-tube heat exchanger. In the preferred embodiment, as can be seen in FIG. 2, the fluid to be cooled enters at the top through tube 1 and passes through the body of heat exchanger in the internal tube 3. Flow continues through the end cap 4 and returns through the internal tubes 3 in fluid communication with the tube 2. The other fluid, such as a cooling fluid, in this heat exchanger enters the shell 7 of the heat exchanger through the inlet tube 5. In the shell 7, the fluid completely surrounds the internal tubes 3 which contain the first fluid but the two fluids cannot mix. The second fluid then exits the heat exchanger through the tube 6.

It will be understood that in other embodiments of the invention, the hot fluid may enter through tube 2 and exit through tube 1 or the second fluid may enter through tube 6 and exit through tube 5. The relative initial temperatures of the fluids may be interchanged such as by placing the hot fluid in the shell 7. In a single pass exchanger embodiment, the exit tube would be disposed in the opposite end, and the exit tube would be in fluid communication with the end cap 4.

Figure 3:
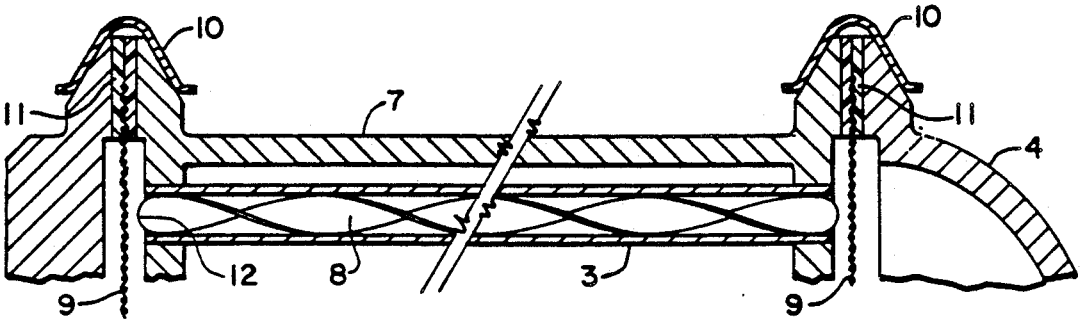
FIG. 3 is a fragmentary sectional view taken along the line 3—3 of FIG. 1.
Figure 4:
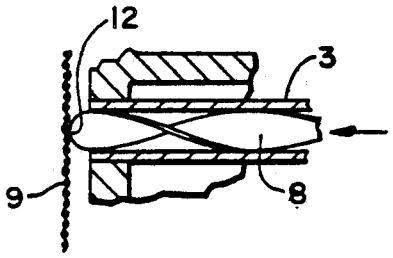
FIG. 4 is a fragmentary sectional view showing the left side of the helical member illustrated in FIG. 3 in greater detail.
Figure 5:
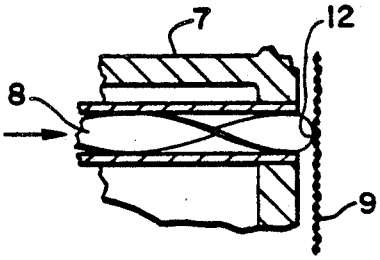
FIG. 5 is a fragmentary sectional view showing the right side of the helical member illustrated in FIG. 3 in greater detail.

In FIG. 3 there is shown a detailed view illustrating the location of one helical member 8 inside one tube 3. As described in the previously issued patents of the present applicant, the helical member 8 is free floating and driven rotationally by movement of the fluid passing through the tube 3. These helical members 8, also referred to collectively as helices 8 are close fitting to the inside of the respective tubes 3 to assure that their movement scrapes away all the stagnant hydrostatic film which inherently forms on any solid surface immersed in a fluid. When the fluid flows through the tubes 3, the free-floating helices 8 therein will move with the fluid. However, after minimal movement, the bearing end 12 of the helical member 8 will contact the porous bearing surface 9 through which the fluid can easily flow. The helical member 8 will not move past the porous bearing surface 9 because the openings therein are not sufficiently large. Being thus restrained, the helical member 8 will then be rotated by the fluid which is now moving past the helical member 8 instead of with it. In FIG. 4, the helical member 8 is being forced against the mesh screen 9 and in FIG. 9 the helical member 8 is being forced against the right screen 9 by the respective fluid flows. In either instance, the rounded bearing tip 12 assures that there is no cutting or binding force imposed by the screen 9 on the helical member 8, and that wear is minimized and distributed evenly over the bearing element 9 at the point of contact.

Figure 9:
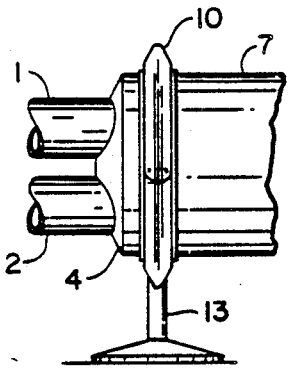
FIG. 9 is a front elevational view of a portion of the heat exchanger shown in FIG. 1 mounted on a clamp member having an internal v-shaped surface.
Figure 10:
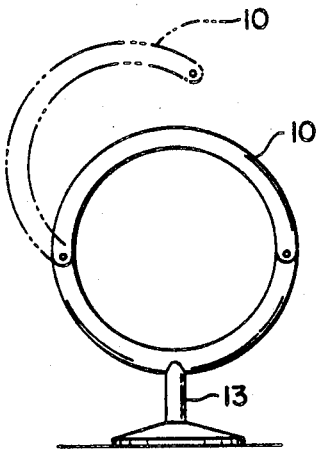
FIG. 10 is another view of the clamping member shown in FIG. 9 illustrating the manner in which the clamp opens to allow removal of the heat exchanger.

The bearing elements 9, are a particular feature of the present invention and are permanently mounted in the sealing gaskets 11 which may be of any substance resistant to the cooling or heating action of the fluids in the shell 7. The end caps 4 are held against the body of the shell 7 by a Marmon clamp 10 which completely surrounds the body of the heat exchanger and which has an internal circumferential v-shaped groove compress the gaskets so as to seal the fluid inside the shell 7. The term "Marmon" will be understood to be a trade name identifying a clamp having a circular shape and a v-shaped slot therein for cooperation with mating flanges of two cooperating ducts. The v-shaped seat in the Marmon clamp is tapered to compress the gaskets 11 so as to seal the fluid inside the shell 7. FIGS. 9 and 10 illustrate the installation of a Marmon clamp 10 having two discrete arcuate sections which are pivotably connected to allow insertion of flanges such as the flanges between the shell 7 and the end cap 4.

Figure 6:
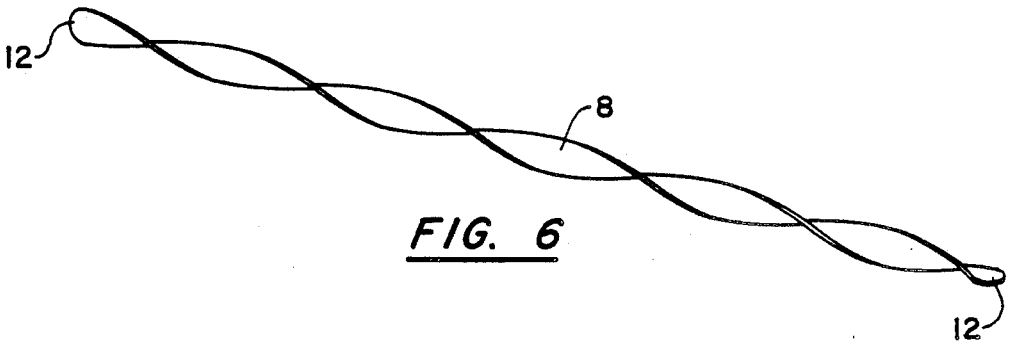
FIG. 6 is a perspective view of the helical member shown in FIGS. 3, 4 and 5.
Figure 8:
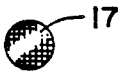
FIG. 8 is an elevational view of the screen bearing plate in accordance with the present invention.

Referring now to FIG. 6 there is shown a detailed drawing of a helix 8 which is free floating and which turns with the movement of a fluid in the tube 3 in which the helix is disposed. It will be seen that the bearing tips 12 are rounded to assure minimal wear and abrasion. The twists in the helix 8 are uniform throughout the length thereof. There is no real limit to the length or width of the helices 8 except that they should fit closely inside the tube 3 of the heat exchanger, regardless of whether it is a shell-and-tube type a fin-tube type, or a double pipe type heat exchanger.

The length of the helical member 8 is ordinarily a fraction of an inch less than the distance between the bearing/screening elements 9. In this way, the axial extent of the walls of the tube 3 scraped is maximized and the longitudinal movement of the helix is minimized, and rotation of the helix 8 is not restricted. The helical member 8 can be made of any solid material which is either resistant to, or even sacrificial to the composition of the fluid in which it is immersed. In general, the helical member 8 will be metallic and if it is designed to be sacrificial, it will be sacrificial to the degradation products of the fluid, rather than to the fluid itself. If the fluid is, for example, a glycol which tends to be oxidized during use, the helix will ordinarily be made of, or coated with magnesium, so this effect is minimized.

Figure 7:
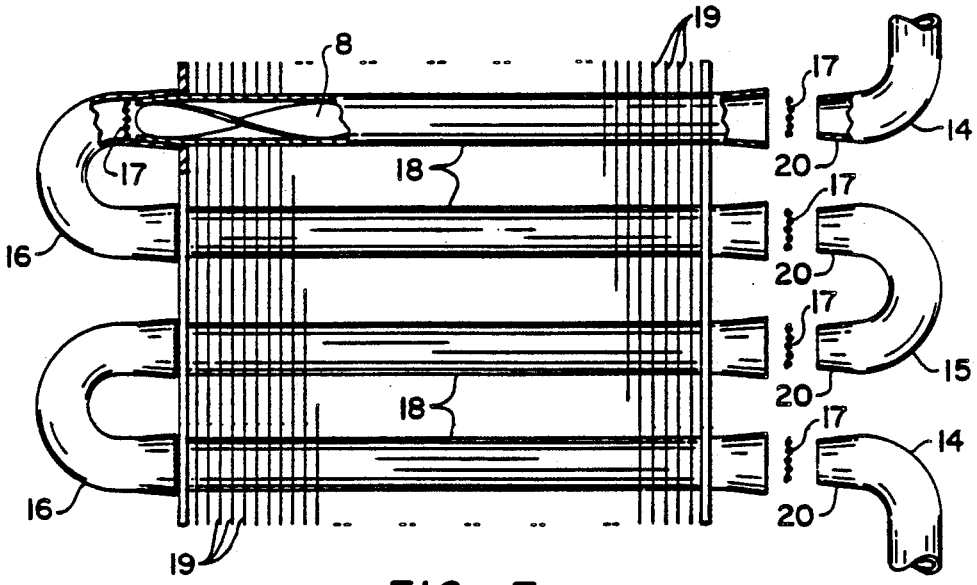
FIG. 7 is partially schematic, partially exploded view of a tube and fin heat exchanger in accordance with another form of the present invention.

FIG. 7 is a drawing of an oil cooler of the fin-in-tube type. In such a design, the coolant is almost universally air, although other fluids are entirely acceptable. This same design, modified for size and fluid, is used in air conditioners for releasing excess heat to the air. The oil, or other fluid, such as Freon in air conditioners, enters the heat exchanger through either of the inlet/outlet tubes 14. In this design, the inlet tube is tapered so as to fit into the cooling tube 18. During assembly, a screen 17 is inserted in the assembly between the inlet tube 14 and the cooling tube 18. The inlet tube 14 is tapered, the screen can be the same size as the outside diameter of the tapered end 20 which is still larger than the inside diameter of the cooling tube 18. In this way, the screen/bearing element 17 is fixed firmly in place in held by the inlet element opening 20 on one side and by the inside of the cooling tube 18 on the other side. Being firmly fixed, it can act as a bearing element for helices 8 which are enclosed in every cooling tube 18. At the other end of this oil cooler, the bends 16 are flared instead of tapered so that they fit outside of the cooling tube 18, instead of the inside as does the U-shaped tube 15 at the other end. This illustrates that either way provides a ready method of assembly of the bearing element 17 to retain the helices 8 and to screen the fluids contained in the system.

Figure 11:
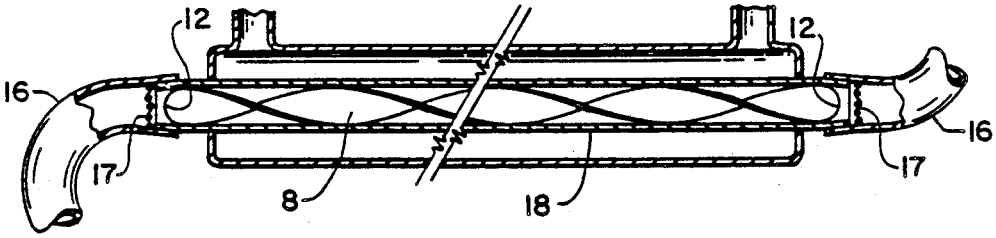
FIG. 11 is a front elevational view of a double pipe heat exchanger in accordance with one form of the invention.

Since double-pipe heat exchangers are constructed similarly to fin tube heat exchangers, many elements of the double-pipe heat exchanger shown in FIG. 11 are similar to those shown in FIG. 7. The helical member 8 is similarly constructed with a rounded end 12 which is disposed close to, but not in direct contact, with the retainer/screen 17. In the case of the double-pipe heat exchangers, the pipes 18 are generally straight and the U-bends 16 are flared to receive them. As with the fin and tube heat exchanger, the retainer/screen 17 is cut to the same diameter as the outlet diameter of the tubes so that they are held in place by the tubes and are held onto the tubes 18 by the flared U-bends 16.

Since many double-pipe heat exchangers include stacks of these tubes mounted in a bracket, the bracket may be held in place by a few bolts allowing for easy disassembly and cleaning or replacement. When the bracket is loosened, all the U-bends will then be free and can be removed only to be clamped back in place when cleaning and replacement is completed.

It has been found that the screen bearing plates, such as 17 or 9 function well as a fluid cleaning element as well as being more versatile for use as a bearing plate for the helices 8. The use of the screen bearing plate 9 or 17 prevents accumulation of particles or other debris which would degrade or contaminate other parts of the system. Thus the bearing plate becomes multi-functional because it is both a bearing plate and also acts as a screen or filter which can clean the fluid and be replaced or cleaned as debris from the fluid clogs the screen. For viscous fluids, the bearing plate should be made of 10 or 20 mesh screen to allow the fluid to pass easily. For gasses, bearing elements 17 are usually 60 to 100 mesh screen, terracotta, frittered glass, sintered metal or the like.

If screening is to be used, various weaves are commercially available. The most open weaves are preferable. In the case of a shell-and-tube heat exchanger, for example, one bearing element 17 serves as a retainer for a multitude of helices 8. The aggregate cross-sections of the tubes 3 vary from 10 percent to about 40 percent of the total cross section of the shell 7. Since the bearing elements fits over the entire cross-section shell 7, as long as the screen 9 is more open than the tube plate, the drag it imposed in the fluid cannot become a significant restriction on the flow or cause measurable pressure drop. The use of a screen or other porous material greatly simplifies the manufacture of the bearing element, since the passage of the fluids is uniformly distributed over the entire surface and no design of a pattern of holes or a judiciously place slots is required. In addition, as long as the openings in the screen are substantially smaller than the holes in the tubes, the screen can be place directly against the tube-plate of the heat exchanger, and the fluid can still easily find a path-way through. This feature greatly eases the mounting design of the bearing element, since the spacing between it and the tube is not critical. The preferred embodiment of this invention, does not place the bearing element directly against the tube plate, however, since imposing unnecessary restriction upon the flow of the fluids cannot be condoned.

One of the major improvements of the present invention, is the ready disassembly and reassembly of the unit for the purposes of cleaning, or changing either helices or screen bearing plates. In the shell-and-tube heat exchangers, the shell is commonly bolted to a flange on the tube plate. Smaller units up to 4 inches in diameter often have 4 bolts holding the end caps securely to the tube-plate flange, to prevent leakage or separation case of over pressurization. Larger units from 5 to 36 inches in diameter have anywhere from 6 to 60 such bolts or even more. These holes impose a fairly stringent demand of the design on the gasket to seal the end plate against the flange of the tube plate. They also represent a major time-consuming project to remove if the unit needs to be open for any reason including failure or cleaning. Still further, even after one disassembly the gaskets present a serious source of leakage and usually are replaced rather than reused. In the present invention, there are no bolts holding the end-plate on to the tube-plate flange. There are also no bolt holes, nor any pre-drilled gaskets to match the bolt pattern of that particular heat exchanger. Instead, these two units of the same diameter are retained by closely fitted circular channel which is part of mounting bracket or stand. This channel is made with a slight taper so that it is fitted onto the two flanges and squeezes them together making a fluid-type seal which will not allow any fluid from inside to escape to the outside. This closely fitted and tapered channel is split into two hinge pieces as shown in FIGS. 9 and 10. These pieces extend through respectively a 185 degrees arc and a 175 degrees arc. The smaller half of the channel 10 is mounted on and is part of a stand or mounting bracket 13 for the heat exchanger. As the flanges of the tube and end plates are fitted into this smaller half of the channel 10, the larger half on hinge can be clamped over the remaining periphery of the flange and can be locked in place with a removable pin. Now the two flanges containing the tube plate and the end cap are held tightly together around their entire periphery with a rigid channel which retains them, and compresses the sealing gaskets between them against any internal pressure. The unit can be opened at any time merely by removing the pins from the retaining channels, opening the channels and taking out the heat exchanger. The end cap and the header can then be separated merely by breaking the seal. If the seal is made of a heat and chemically resistant elastomer such as Viton, PTFE, EPDM or nitrile rubber, no gasket seal is needed or recommended. The seal can then be reused. The bearing element 17 or 9 in accordance with the present invention is mounted in, and becomes a part of the seal between the end plate and the tube plate. This is a relatively simple matter, since the bolt holes are not longer needed, and such holes need not be in the bearing plate. One easy method is to place the bearing element between two such precut gaskets, then the job is complete. This process will also automatically assure that the bearing element is not directly against the tube-plate. The reason for this easy access arrangement, is to provide a readily replaceable or cleanable screen or filter for the fluid being heated or cooled. This screen is also the bearing element for the helices 8 in the tube 3. Since the end caps are usually fitted to a permanent piping, these must be disassembled to allow the end caps to be removed. In the present design, the end caps need not be moved at all and the body of the heat exchanger may be removed without disturbing the end caps.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described my invention I claim:

1. A heat exchanger comprising:

an outer envelope having an inlet and an outlet for passage of an associated first heat exchange fluid therethrough;

a first tube mounted within the envelope for external contact by the first heat exchange fluid, and adapted for passage of a second heat exchange fluid therethrough in physical isolation from the first heat exchange fluid, a generally helical blade disposed within the first tube for free rotation and free axial movement, said helical blade having a laterally centered bearing portion on at least one end thereof, said helical member having a diameter relative that of the first tube, such as to cause said helical blade to pass in closely spaced relation to the inside surface of said first tube during rotation; and a bearing member disposed adjacent at least one end of the helical blade which comprises a porous member disposed in substantially aligned relationship with said helical blade and means for directing the second heat exchange fluid, said bearing member being disposed in said means for directing and extending across substantially the entire extent thereof whereby the second heat exchange fluid passes through said bearing member.

2. The apparatus as described in claim 1 wherein:
said helical blade includes at least one axial extremity that is a bearing surface for cooperation with said bearing member, said bearing surface being rounded.

3. The apparatus as described in claim 2 wherein:
said bearing surface has a radius of curvature that is at least as great as the inside radius of said first tube.

4. The apparatus as described in claim 3 wherein:
said bearing member is a mesh screen.

5. The apparatus as described in claim 4 wherein:
said mesh screen is between 10 and 20 mesh.

6. The apparatus as described in claim 4 wherein:
said mesh screen is between 60 and 100 mesh.

7. The apparatus as described in claim 3 wherein:
said bearing member is terracotta.

8. The apparatus as described in claim 3 wherein:
said bearing member is frittered glass.

9. The apparatus as described in claim 3 wherein:
said means for directing includes a generally U-shaped tube engaging said first tube.

10. The apparatus as described in claim 9 wherein:
said generally U-shaped tube has a diameter greater than said first tube and said bearing member is disposed intermediate said first tube and said U-shaped tube.

11. The apparatus as described in claim 3 further including:
means for holding said bearing member in said means for directing.

12. The apparatus as described in claim 11 wherein:
said means for holding said bearing member in said means for directing includes interconnecting axial extremities of respective tubes having different diameters and said bearing member is trapped by said interconnecting axial extremities.

13. The apparatus as described in claim 12 further including:
sealing means disposed around the peripheral portions of said bearing member.

14. The apparatus as described in claim 3 further including:
means for quickly connecting and disconnecting a fluid coupling to said heat exchanger including axially tapered first and second flanges and a clamp which has an internal circumferential V-shaped grove to clamp said first and second flanges together.

15. The apparatus as described in claim 14 wherein:
said clamp includes first and second first and second arcuate sections which are pivotably connected to allow insertion of said first and second flanges therebetween.

16. The apparatus as described in claim 3 wherein:
said bearing member is sintered metal.

17. The apparatus as described in claim 4 further including:
flexible inlet and outlet hoses.

* * * * *